United States Patent [19]

Bell, III et al.

[11] Patent Number: 4,676,042

[45] Date of Patent: Jun. 30, 1987

[54] SUBPURLIN AND ATTACHMENT ASSEMBLY

[75] Inventors: John R. Bell, III, Germantown; Robert E. Hodges, Jr., Memphis, both of Tenn.; Harold E. Martin, LaGrange, Ga.

[73] Assignee: AMCA International Corporation, Hanover, N.H.

[21] Appl. No.: 794,076

[22] Filed: Nov. 1, 1985

[51] Int. Cl.[4] ..... E04D 1/00

[52] U.S. Cl. ..... 52/543; 52/478; 52/508

[58] Field of Search ..... 52/543, 478, 508, 573, 52/698, 741

[56] References Cited

U.S. PATENT DOCUMENTS

| | | | |
|---|---|---|---|
| 3,031,044 | 4/1962 | Stitt et al. . | |
| 3,332,186 | 7/1967 | Cammaert | 52/534 X |
| 3,394,516 | 7/1968 | Taylor et al. . | |
| 3,975,880 | 8/1976 | Fischer, Jr. | 52/573 X |
| 3,998,019 | 12/1976 | Reinwall | 56/478 |
| 4,081,938 | 4/1978 | Bertacchi et al. . | |
| 4,114,338 | 9/1978 | Beck | 52/478 |
| 4,329,823 | 5/1982 | Simpson | 52/508 X |
| 4,361,993 | 12/1982 | Simpson | 52/407 X |
| 4,406,106 | 9/1983 | Dinges | 52/478 |
| 4,466,224 | 8/1984 | Hague | 52/478 |
| 4,486,998 | 12/1984 | Hague . | |

*Primary Examiner*—William F. Pate, III
*Assistant Examiner*—Creighton Smith
*Attorney, Agent, or Firm*—Richards, Harris, Medlock & Andrews

[57] ABSTRACT

A subpurlin (10) is provided for a building assembly having a plurality of overhead structural members (50), an insulating layer (62) and a plurality of overlapping roof panels (56). The subpurlins (10) support and space the roof panels (56) without compressing the insulating layer (62). Connector assemblies (30) secure the subpurlins (10) on the structural members (50) while permitting differential thermal movements between the roof panels (56) and the structural members (50). The connector assemblies (30) have ferrules (32) which slidingly engage slots (16) in the subpurlins (10). Washers (34) are fastened to the structural members (50) through the ferrules (32) during subpurlin (10) installation.

27 Claims, 5 Drawing Figures

SUBPURLIN AND ATTACHMENT ASSEMBLY

FIELD OF INVENTION

This invention relates to metal building systems and, more particularly, to an intermediate subpurlin for spacing roof panels above an underlying support structure.

BACKGROUND OF INVENTION

A typical roof structure for metal buildings includes a structural support system covered by a plurality of overlapping roof panels. Roof panels are generally formed from sheet materials to define ribs and other contours which provide rigidity and strength to the panels. Mating ribs may be provided where panels overlap for improved interlocking and weather integrity.

As a building heats and cools, the structural support system and the roof panels may experience dimensional changes from thermal expansion and contraction. There is frequently differential movement between the roof panels and underlying structure. Where the roof panels are rigidly fixed to the underlying structure, stresses and physical deformation can be produced in the roof panels, particularly along panel widths perpendicular to the panel ribs.

In a conventional building system, the roof panels are fastened to the underlying structure at low points or valleys in the panel contour. Water run-off and collection also occur along the panel valleys. Thus, the valley locations where fasteners penetrate the roof panels are often the source of water leakage and of roof panel degradation.

A building roof structure may also include an insulating layer between the structural support system and the overlying roof panels. The thickness of the insulating layer may be considerably reduced where the roof panels are fixed to the structure. Compressing the insulating layer thickness greatly decreases the insulating effectiveness of the layer.

U.S. Pat. No. 4,114,338 to Beck teaches a reinforcing plate for use beneath end lapped thin gauge sheets to provide structural support adjacent the joints for improved sealing. The reinforcing plate is elevated above the underlying insulation and is fastened to an underlying purlin through downwardly depending flanges having mounting slots therein. However, there is no provision to assure that the reinforcing plate is not rigidly fixed to the underlying structure. Further, the roofing sheets are fixed to the reinforcing plates along valleys where water run-off and collection can occur.

U.S. Pat. Nos. 4,361,993 and 4,329,823 to Simpson teach a support spacer apparatus for engaging an overlying ribbed panel in a manner to support the panel above the building support structure without compressing the underlying insulation. However, Simpson rigidly fastens the component parts together to provide for structural strength increases.

U.S. Pat. No. 3,332,186 to Cammaert does teach structure for enabling relative movements between corrugated sheet roofing and underlying rafters. Sliding members are fixed to raised corrugations and engage intermittent slideways which are fixed to the rafters to enable relative movements parallel to the corrugations. There is no suggestion about adapting the slider and slideway system to an insulated assembly.

These and other disadvantages in the prior art are overcome by the present invention wherein a subpurlin is provided in a contour effective to support roof panels without compressing underlying insulation while providing elevated fastening support areas and having a clip for slidably fastening the subpurlin to underlying support structure.

SUMMARY OF THE INVENTION

In a preferred embodiment of the present invention, a subpurlin is provided for interconnecting a roof structural assembly and roof deck panels. The subpurlin is formed as an elongate member defining a plurality of slotted openings, each having a length which is effective to accommodate expansion and contraction movements of the roof deck panels relative to the underlying structural assembly. A connector is provided for slidably engaging the elongate member adjacent the roof structural assembly and beneath the roof deck panels. The connector includes a washer defining a bearing surface, and a ferrule which slidably engages a slotted opening in the elongate member, where the ferrule has a length which is effective to maintain the washer above the opening and in spaced relationship with the elongate member.

A method of assembly is also provided for forming an insulated roof structure over a plurality of underlying structural members. Insulating material is placed above and generally transverse to the structural members. A first subpurlin is placed above the insulating material and along one of the structural members, where the subpurlin has a plurality of low cell areas adjacent the structural member which define respective expansion slots therethrough, and a plurality of high cell areas extending above the insulating material. The subpurlin includes a plurality of spanner sections between and supported by the low cell areas. Bearing surfaces are formed above the expansion slots and spaced above the slots on ferrules extending through the slots. The bearing surfaces are fastened to the structural members through the ferrules, each of the ferrules maintaining its associated bearing surface spaced above the expansion slot.

An improved building assembly is provided having a plurality of overhead structural members, an insulating layer, and a plurality of overlapping external roof panels, where a plurality of subpurlins are provided for supporting and spacing the roof panels above the structural members. Connectors attach the subpurlins to the structural members in a manner which enables relative thermal movement between the roof panels and the structural members. Each subpurlin is an elongate member defining a plurality of slotted openings, each having a length which is effective to accommodate the expansion and contraction movement of the roof deck panels relative to the structural assembly. The connector slidably engages the elongate subpurlin adjacent the roof structural assembly and beneath the roof deck panels. Each connector includes a washer which defines a bearing surface and a ferrule which slidably engages a subpurlin slotted opening and which has a length effective to maintain the washer above the opening in a spaced apart relationship with the elongate member.

These and other characteristics of the present invention will become apparent from the following detailed description, wherein reference is made to the figures in the accompany drawings.

IN THE DRAWINGS

DETAILED DESCRIPTION

Figures 1, 2, 3:
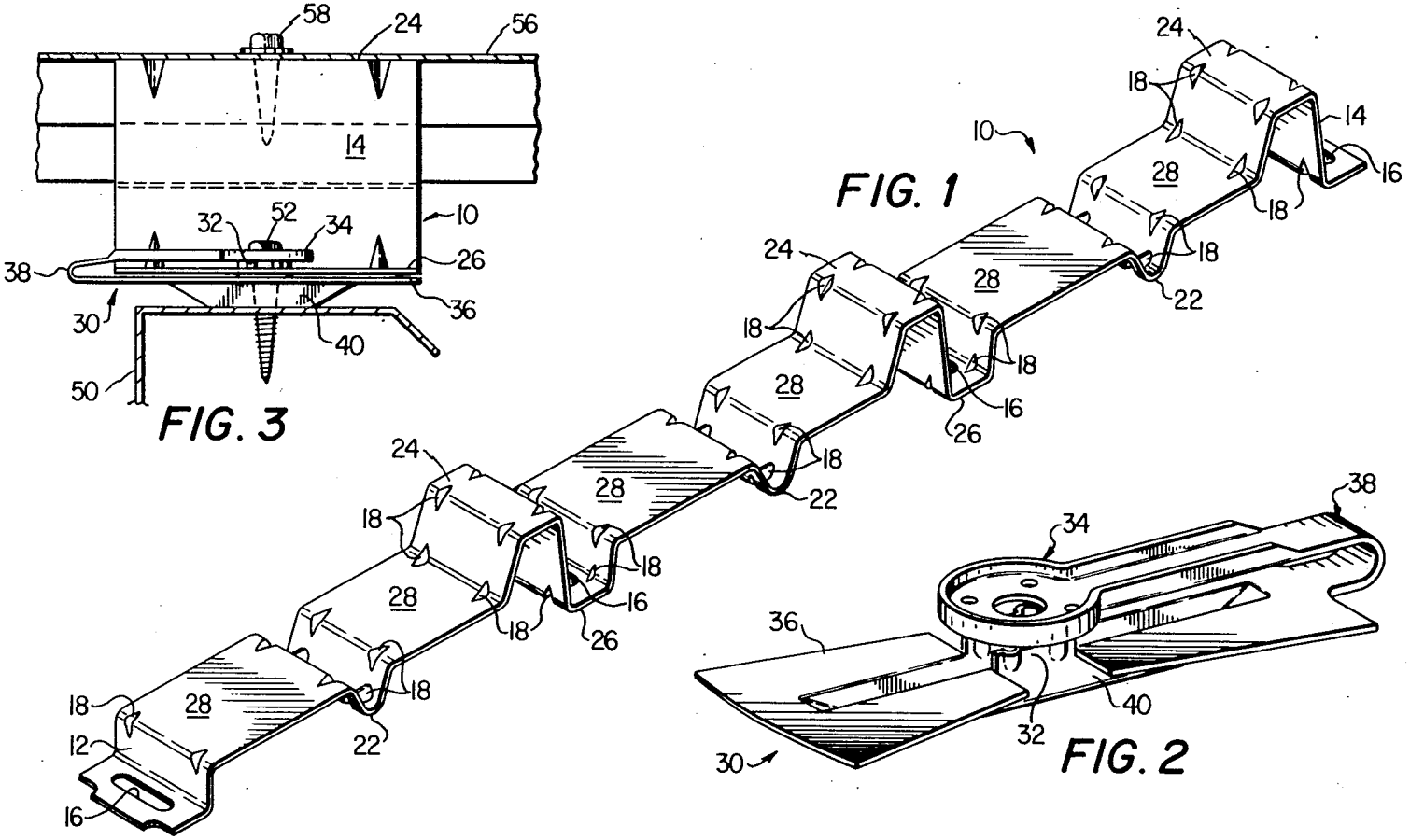
FIG. 1 is a pictorial illustration of one embodiment of a subpurlin in accordance with the present invention.
FIG. 2 is a pictorial illustration of one embodiment of a subpurlin fastening clip.
FIG. 3 is a side elevation in partial cutaway of an installed subpurlin with clip.

Referring now to the figures, and more particularly to FIG. 1, there is shown one embodiment of subpurlin 10 according to the present invention. Subpurlin 10 is formed as an elongate member having a lap end 12 and rib end 14. Lap end 12 mates with the rib end 14 of an adjacent subpurlin 10, as hereinafter explained. In a preferred embodiment, subpurlin 10 is about 36 inches long and three inches wide, a size consistent with conventional building materials.

Subpurlin 10 defines a plurality of expansion slots 16 along its length. An expansion slot is included at lap end 12 and rib end 14 and at intermediate locations where subpurlin 10 contacts the underlying support structure.

The configuration of the elongate subpurlin 10 includes intermediate bearing stiffeners 22, high cell ribs 24, low cell ribs 26 and connecting spanner sections 28. Spanner sections 28 are supported above underlying structural members by flanges at lap end 12 and rib end 14, by intermediate bearing stiffeners 22, and by low cell ribs 26. Bearing stiffeners 22 serve to provide the desired rigidity to spanner sections 28 at desired locations. Reinforcing embossments 18 provide additional strength at locations where subpurlin 10 is bent.

Preferably low cell ribs 26 further define slots 16. Slots 16 have a length which is effective to enable relative thermal expansion movements to occur between the overlying roof structure and the underling structural members, as hereinafter explained. High cell ribs 24 may be provided in a variety of configurations. It is desirable, however, that the selected configuration be compatible with elongate ribs of the overlying roof deck panels to provide for attaching the deck panels to the high cell ribs 24.

Referring now to FIG. 2, there is shown connecting slider assembly 30 for joining subpurlin 10 with the underlying structural members. Slider tab 32 is formed as a ferrule for engaging expansion slots 16 in subpurlin 10 (see FIG. 1). Washer 34 is placed above ferrule 32 and defines a bearing surface for use in fastening the assembly together, as hereinafter explained. As shown in FIG. 2, washer 34 is supported above ferrule 32 by connecting biasing arms 38 to form a unitary connector assembly 30 which is convenient for field installation.

Thus, referring to FIGS. 1 and 2, connecting slider assembly 30 is installed by urging washer 34 above a low cell rib area 26 of subpurlin 10 and along low cell rib 26 until ferrule 32 is engaged through expansion slot 16. Bottom sliding surface 36 may then be dimensionally formed to have the same length as the width of subpurlin 10 so that alignment is easily accomplished, either visually or by feel. Structural bearing surface 40 is placed adjacent an underlying structural assembly member, a fastener is inserted through washer 34 and ferrule 32, and the fastener is rotated to secure washer 34 against ferrule 32. The dimensions of ferrule 32 are selected such that expansion slot 16 slidably engages ferrule 32 when washer 34 is clamped against ferrule 32. Thus, low cell rib areas 26 slidably engage bottom sliding surface 36 as the assembly is fastened to the underlying support structure.

Referring now to FIG. 3, there is depicted a side elevation, in partial cutaway, of a subpurlin 10 fastened through connector 30 to an underlying structural member 50. Structural member 50 may be a purlin or may be a primary structural member such as a bar joist. Biasing arms 38 have been spread to move connecting slider assembly 30 about rib end 14 (as shown in FIG. 1) until ferrule 32 has engaged through expansion slot 16 (not shown). Structural bearing surface 40 of slider assembly 30 is placed adjacent structural member 50 and fastener 52 is installed to secure washer 34 adjacent ferrule 32 and connector assembly 30 to structural member 50. Thus, the flange portion of rib end 14 is fastened, but not clamped, to structural member 50 wherein expansion slot 16 (not shown) can slide about ferrule 32 and beneath washer 34 over sliding surface 36 to accommodate relative movement between the overlying roof panel and structural member 50. Finally, a rib of roof panel 56 has been placed over high cell rib 24 adjacent rib end 14 and fastened to high cell rib 24 by fastener 58.

Figure 4:
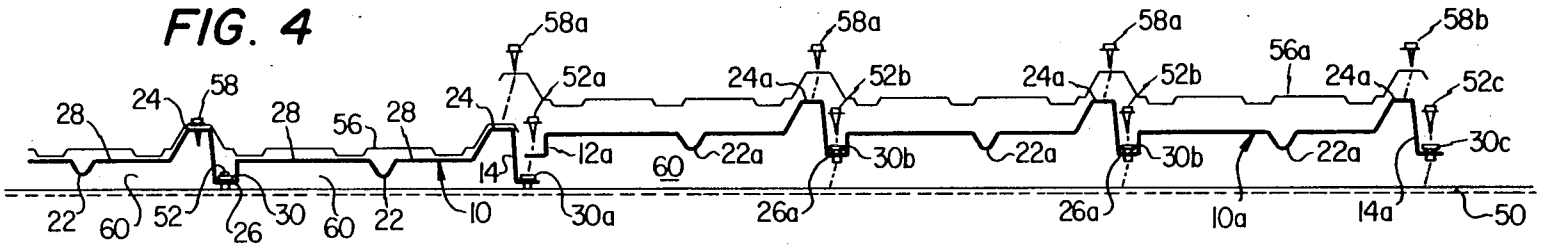
FIG. 4 is an exploded side view of an installation showing a sequence of assembly.

A typical installation sequence for installing subpurlins 10 and overlying roof panels 56 is shown in FIG. 4. At the left side of FIG. 4, a first subpurlin 10 is fastened to structural member 50 at intermediate low cell rib 26 with fastener 52 secured through connecting slider assembly 30. Intermediate bearing stiffeners 22 support spanner sections 28 above support member 50, forming insulation space 60 to accommodate insulating material without compressing the insulating material. Roof panel 56 is secured to high cell ribs 24 of subpurlin 10 with fastener 58. Installation of subpurlin 10 is completed except rib end 14 is not secured to support member 50 and the adjoining roof panel is not secured to high cell rib 24 adjacent rib end 14.

Adjoining subpurlin **10*a* is next installed. Lap end 12*a* is placed adjacent rib end 14. Connector slider assembly 30*a* may be slipped over both flange areas where the ferrule 32 (FIG. 2) passes through the mating expansion slots (not shown) of lap end 12*a* and rib end 14. Fastener 52*a* now fixes slider assembly 30*a* to support member 50. Subpurlin 10*a* is then fixed along support member 50 by successively fastening slider assemblies 30*b* with fasteners 52*b*** *l until rib end 14a* is reached. If subpurlin **10*a* is the last subpurlin in a given sheet run (i.e., the distance from eave to endlap, eave to ridge, etc.), then installation is completed by installing slider assembly 30*c* with fastener 52*c*. Otherwise the next subpurlin is placed adjacent rib end 14*a***, as hereinabove described.

Roof sheets 56 and **56*a* are fastened to subpurlins 10 and 10*a* with fasteners 58, 58*a*, 58*b* at high cell ribs 24, 24*a*. It will be appreciated that fasteners 58, 58*a*, 58*b* are fixed to raised locations of roof sheet panels 56, 56*a* such that water properly drains away from fasteners 58, 58*a*, 58*b*** and does not accumulate in a manner to cause leakage or corrosion of roof panel material adjacent the fasteners.

Figure 5:
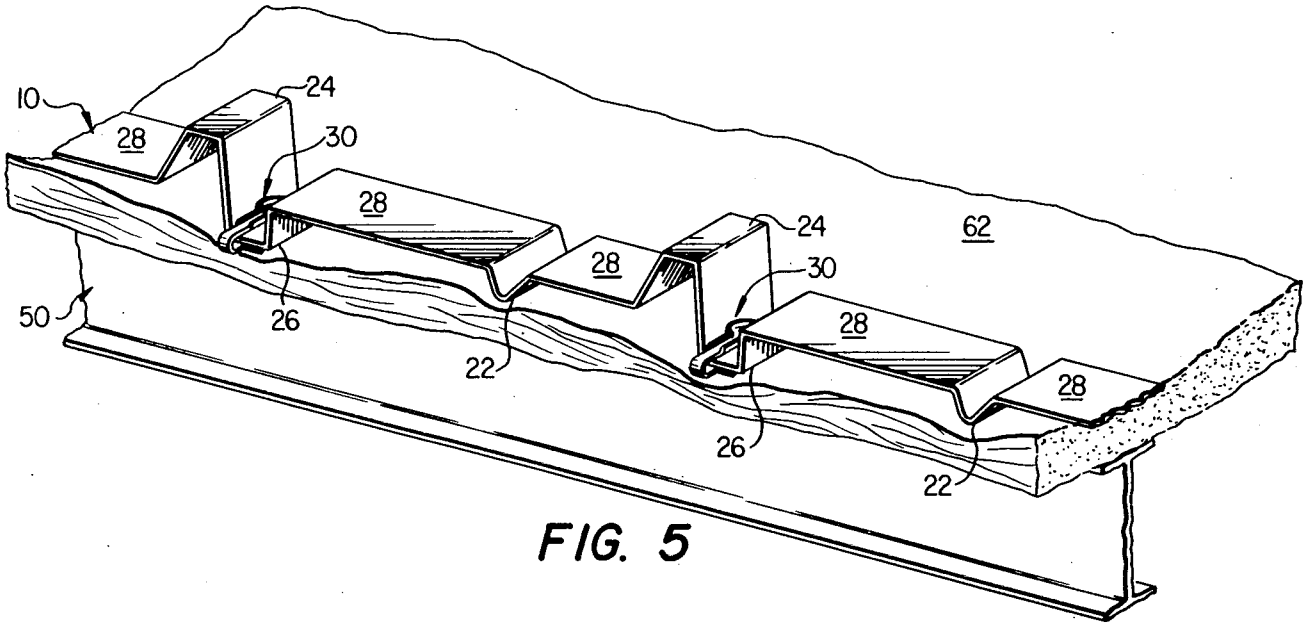
FIG. 5 is a pictorial illustration of a building component assembly incorporating embodiments of the present invention.

A pictorial illustration of a subpurlin assembly according to the present invention and installed on a structural support member having a layer of insulating material is shown in FIG. 5. Subpurlin 10 has been placed along support member 50 and fixed to support member 50 by fasteners fixed through connector slider assemblies 30. Low cell ribs 26 and bearing stiffeners 22 support spanner sections 28 above insulation 62 without any substantial compression of insulation 62. High cell ribs 24 extend above insulation 62 to support overlying roof panels (not shown) above insulation 62. Thus, the overlying roof panels (not shown) will be fastened to subpurlins 10. Subpurlins 10 will be slidingly fixed to support member 50 through connecting slider assemblies 30. Relative thermal movements transverse to support member 50 occur without producing strains on overlapping longitudinal ribs of the overlying roof panels 56 (not shown).

It is therefore apparent that the present invention is one well adapted to obtain all of the characteristics hereinabove set forth together with other characteristics which will become obvious and inherent from a description of the product itself. It will be understood that certain combinations and subcombinations are of utility and may be obtained without reference to other features and subcombinations. This is contemplated by and is within the scope of the present invention.

What is claimed is;

1. A subpurlin assembly for interconnecting a roof structural assembly and roof deck panels, each roof deck panel expanding and contracting in the plane of the panel, comprising:

an elongate member defining a plurality of slotted openings, the openings lying in a plane parallel the plane of expansion and contraction of the roof deck panels, each said slotted opening having a length effective to accommodate the expansion and contraction movement of said roof deck panels relative to said structural assembly;

connector means mounted on said structural assembly defining a support surface lying in a plane parallel the plane of expansion and contraction for supporting said elongate member about each slotted opening for slidable motion of the elongate member relative to the connector means between said roof structural assembly and beneath said roof deck panels, said connector means further including:

washer means defining a bearing surface, and ferrule means for slidably engaging said slotted opening and having a length effective to maintain said washer means above said opening in a spaced apart relationship with said elongate member so that the elongate member can slide freely on the support surface guided by the ferrule means in response to expansion and contraction of the roof deck panels.

2. A subpurlin assembly for interconnecting a roof structural assembly and roof deck panels, comprising:

an elongate member defining a plurality of slotted openings, each said slotted opening having a length effective to accommodate expansion and contraction movement of said roof deck panels relative to said structural assembly;

connector means for slidably engaging said elongate member adjacent said roof structural assembly and beneath said roof deck panels, said connector including:

washer means defining a bearing surface, and ferrule means for slidably engaging said slotted opening and having a length effective to maintain said washer means above said opening in a spaced apart relationship with said elongate member;

said connector further includes:

bias means for connecting said washer means and said ferrule means to form a unitary connector assembly, said bias means being effective for sliding said connector assembly about said elongate member to engage said ferrule through said opening.

3. A subpurlin assembly according to claim 1, wherein said elongate member includes at least one spanner section adjacent said at least one opening and vertically spaced above said at least one opening for retaining insulating space between said spanner section and said roof structural assembly.

4. A subpurlin assembly according to claim 3, further including a plurality of low cell areas spaced along said spanner section for supporting said spanner section above said structural assembly.

5. A subpurlin assembly according to claim 4, wherein said connector means engage said elongate member along at least one of said plurality of low cell areas.

6. A subpurlin assembly according to claim 3, 4, or 5, further including a plurality of high cell areas spaced along said at least one spanner section for fastening with said roof deck panels.

7. A subpurlin assembly for interconnecting a roof structural assembly and roof deck panels, comprising:

an elongate member defining a plurality of slotted openings, each said slotted opening having a length effective to accommodate expansion and contraction movement of said roof deck panels relative to said structural assembly;

connector means for slidably engaging said elongate member adjacent said roof structural assembly and beneath said roof deck panels, said connector including:

washer means connector defining a bearing surface, and ferrule means for slidably engaging said slotted opening and having a length effective to maintain said washer means above said opening in a spaced apart relationship with said elongate member;

said elongate member including at least one spanner section adjacent said at least one opening and vertically spaced above said at least one opening for retaining insulating space between said spanner section and said roof structural assembly;

a plurality of high cell areas spaced along said at least one spanner section for fastening with said roof deck panels; and said connector further includes:

bias means for connecting said washer means and said ferrule means to form a unitary connector assembly, said bias means being effective for sliding said connector assembly about said elongate member to engage said ferrule through said opening.

8. A method for forming an insulated roof assembly over a plurality of overhead structural members, the roof assembly having ribbed roof panels, each roof panel expanding and contracting in the plane of the roof panel along the direction of the ribbing, comprising the steps of:

placing insulating material above and generally transverse to said structural members;

positioning a first set of connector means along one of said structural members, each connector means defining a support surface lying in a plane parallel the plane of the roof panel and spaced above the structural member, each connector means having a ferrule extending above the support surface;

placing a first subpurlin on the support surfaces of said first set of connector means above said insulating material and along said one of said structural members for supporting a first roof panel, said first subpurlin having a plurality of low cell areas defining respective expansion slots therethrough, the connector means and subpurlin oriented so that a ferrule extends through each expansion slot, the expansion slots lying in a plane parallel the plane of the first roof panel and extending along the direction of the ribbing of the first roof panel, and a plurality of high cell areas, said low cell areas effectively supporting a plurality of spanner sections forming said subpurlin in spaced relation above said insulating material; and fastening each connector means between a bearing surface spaced on each ferrule above said expansion slots, through said ferrule, and to said structural member so that the first subpurlin can slide along the support surfaces of the connector means as the roof panel expands and contracts, guided by the ferrules.

9. A method according to claim 8, including the steps of:

installing a second subpurlin along said one of said structural members, a lap end of said second subpurlin joining a rib end of said first subpurlin, said lap end and said rib end defining mating expansion slots therethrough;

forming one of said bearing surfaces spaced on one of said ferrules above said mating expansion slots; and fastening said one of said bearing surfaces on said one of said ferrules to said structural member.

10. A method according to claim 8, further including the steps of:

placing roof panels onto said subpurlins, each said roof panel having ribs corresponding with said high cell areas; and fastening said roof panels to said subpurlins along said ribs of said roof panels effectively engaging said high cell areas of said subpurlins.

11. A method according to claim 10, further including the step of installing all said subpurlins forming a roof sheet panel run before installing any of said roof panels.

12. A method for forming an insulated roof assembly over a plurality of overhead structural members, comprising the steps of:

placing insulating material above and generally transverse to said structural members;

placing above said insulating material and along a one of said structural members a first subpurlin having a plurality of low cell areas defining respective expansion slots therethrough and a plurality of high cell areas, said low cell areas effectively supporting a plurality of spanner sections forming said subpurlin in spaced relation above said insulating material;

forming bearing surfaces spaced on ferrules above said expansion slots;

fastening each of said bearing surfaces through an associated one of said ferrules to said structural member; and forming said bearing surfaces on said ferrules including the steps of:

forming a connector assembly with said bearing surface biased above and toward said ferrule; and sliding said connector assembly over a said low cell area of said subpurlin to engage said ferrule through said respective expansion slot and beneath said bearing surface.

13. In a building assembly having a plurality of overhead structural members, an insulating layer and plurality of overlapping external ribbed roof panels, a plurality of subpurlins for supporting and spacing said roof panels above said structural members and for enabling relative thermal movement between said roof panels and said structural members as each roof panel expands and contracts within its plane along the direction of the ribbing, each said subpurlin comprising:

an elongate member defining a plurality of slotted openings, each said slotted opening having a length effective to accommodate expansion and contraction movement of said roof deck panels relative to said structural members along the direction of the roof panel ribbing;

a plurality of connector means connector for mounting on a structural member, each defining a support surface lying in a plane parallel the plane of the roof panel for supporting the elongate member about each slotted opening to permit sliding motion of the elongate member relative the connector means and structural members to accommodate expansion and contraction of the roof panel, each said connector means further including:

washer means defining a bearing surface, and ferrule means for slidably engaging said slotted opening and having a length effective to maintain said washer means above said opening in a spaced apart relationship with said elongate member to ensure free movement of the elongate member relative the connector means.

14. In a building assembly having a plurality of overhead structural members, an insulating layer and plurality of overlapping external roof panels, a plurality of subpurlins for supporting and spacing said roof panels above said structural members and for enabling relative thermal movement between said roof panels and said structural members, each said subpurlin comprising:

an elongate member defining a plurality of slotted openings, each said slotted opening having a length effective to accommodate expansion and contraction movement of said roof deck panels relative to said structural members;

connector means for slidably engaging said elongate member adjacent said roof structural members and beneath said roof deck panels, said connector means including:

washer means defining a bearing surface, and ferrule means for slidably engaging said slotted opening and having a length effective to maintain said washer means above said opening in a spaced apart relationship with said elongate member; and said connector means further including:

bias means for connecting said washer means and said ferrule means to form a unitary connector assembly, said bias means being effective for sliding said connector assembly about said elongate member to engage said ferrule through said opening.

15. A subpurlin according to claim 13, wherein said elongate member includes at least one spanner section adjacent said at least one opening and vertically spaced above said at least one opening for retaining space for said insulating layer between said spanner section and said roof structural members.

16. A subpurlin according to claim 15, further including a plurality of low cell areas spaced along said spanner section for supporting said spanner section above said structural members.

17. A subpurlin according to claim 15, wherein said connector means engage said elongate member along at least one of said plurality of low cell areas.

18. A subpurlin according to claim 15, 16 or 17, further including a plurality of high cell areas spaced along said at least one spanner section for fastening with said roof deck panels.

19. In a building assembly having a plurality of overhead structural members, an insulating layer and plurality of overlapping external roof panels, a plurality of subpurlins for supporting and spacing said roof panels above said structural members and for enabling relative thermal movement between said roof panels and structural members, each said subpurlin comprising:

an elongate member defining a plurality of slotted openings, each said slotted opening having a length effective to accommodate expansion and contraction movement of said roof deck panels relative to said structural assembly;

connector means for slidably engaging said elongate member adjacent said roof structural assembly and beneath said roof deck panels, said connector including:

washer means defining a bearing surface, and ferrule means for slidably engaging said slotted opening and having a length effective to maintain said washer means above said opening in a spaced apart relationship with said elongate member;

said elongate member including at least one spanner section adjacent said at least one opening and vertically spaced above said at least one opening for retaining space for said insulating layer between said spanner section and said roof structural assembly;

a plurality of high cell areas spaced along said at least one spanner section for fastening with said roof deck panels; and said connector further including:

bias means for connecting said washer means and said ferrule means to form a unitary connector assembly, said bias means being effective for sliding said connector assembly about said elongate member to engage said ferrule through said opening.

20. A subpurlin assembly according to claim 7, further including a plurality of low cell areas spaced along said spanner section for supporting said spanner section above said structural assembly.

21. A subpurlin assembly according to claim 20, wherein said connector means engages said elongate member along at least one of said plurality of low cell areas.

22. A subpurlin assembly according to claim 1, wherein said elongate member has a first end and a second end, a slotted opening being adjacent each end for overlapping an end of another elongate member so that the slotted openings of the mating elongate members are superimposed and a single ferrule means can slidably engage the superimposed slotted openings.

23. The method of claim 9 further including the step of interdigitating the lap end of said second subpurlin between reinforcing embossments on the rib end of the first subpurlin to resist relative lateral motion therebetween.

24. A method according to claim 12, including the steps of:

installing a second subpurlin along said one of said structural members, a lap end of said second subpurlin joining a rib end of said first subpurlin, said lap end and said rib end defining mating expansion slots therethrough;

forming one of said bearing surfaces spaced on one of said ferrules above said mating expansion slots; and fastening said one of said bearing surfaces on said one of said ferrules to said structural member.

25. A method according to claim 12, further including the steps of:

placing roofing panels onto said subpurlins, each said roofing panel having ribs corresponding with said high cell areas; and fastening said roofing panels to said subpurlins along said ribs of said roofing panels effectively engaging said high cell areas of said subpurlins.

26. A subpurlin according to claim 19, further including a plurality of low cell areas spaced along said spanner section for supporting said spanner section above said structural members.

27. A subpurlin according to claim 26, wherein said connector means engage said elongate member along at least one of said plurality of low cell areas.

* * * * *